United States Patent [19]

Schneider

[11] 4,381,570

[45] May 3, 1983

[54] SOFA-BED

[76] Inventor: Charles Schneider, 1040 Whitney Dr., Menlo Park, Calif. 94025

[21] Appl. No.: 241,506

[22] Filed: Mar. 9, 1981

[51] Int. Cl.[3] ..... A47C 17/04

[52] U.S. Cl. ..... 5/13; 5/29

[58] Field of Search ..... 5/13, 28, 51 E, 29, 5/30, 44 R, 48

[56] References Cited

U.S. PATENT DOCUMENTS

| | | | |
|---|---|---|---|
| 2,333,087 | 11/1943 | Bayer | 5/48 |
| 2,352,989 | 7/1944 | Woller | 5/51 E |
| 2,634,427 | 4/1953 | Wodarsky | 5/13 |
| 2,724,126 | 11/1955 | Thomas | 5/13 |
| 2,812,523 | 11/1957 | Laemmle | 5/13 |
| 2,964,760 | 12/1960 | Fox | 5/13 |
| 3,245,091 | 4/1966 | Spitz | 5/51 R |
| 3,380,082 | 4/1968 | Mikos | 5/12 R |
| 3,431,567 | 3/1969 | Spitz et al. | 5/51 R |
| 3,482,270 | 12/1969 | Hill | 5/13 |
| 3,740,775 | 6/1973 | Netayer | 5/13 |
| 4,068,328 | 1/1978 | Gerth | 5/13 |
| 4,173,803 | 4/1979 | Kennedy | 5/13 |

*Primary Examiner*—Alexander Grosz

*Attorney, Agent, or Firm*—Wood, Herron & Evans

[57] ABSTRACT

To increase the comfort of sofa-beds both in bed and seat positions, the intermediate and the deck section coverings (either textile fabric or link fabric) are anchored to fixed, transverse rigid members located at the rear (or head end) of the intermediate section and to the cavity (boxing) section. The intermediate and deck sections are independently supported so as to be stretched tight and firm in bed position and to be loose and flexible in seat position. In the seat position, both the intermediate and the deck sections are spring supported along the rear edge so as to give a soft spring support to a cushion supported from these sections. A textile flap sewn to the textile deck section and passing under a transverse deck reinforcing rod tends, in seat position, to pull the front edge of the deck section downwardly so as to flatten any bulge of the mattress so that the sofa seat cushions rest horizontal and any gaps between such cushions and the top of the front of the sofa frame are eliminated.

16 Claims, 10 Drawing Figures

SOFA-BED

This invention relates to sofa-sleepers or so-called sofa-beds. More particularly, this invention relates to a new and improved sofa-bed having an improved sleeping and seating surface.

Conventional sofa-beds consist of four sections which are disposed horizontally in bed position and fold to approximately 90° angles with respect to adjacent sections in seating position. The folding occurs at joints in the side members of the frame. For convenience, these four sections will be termed herein, proceeding from the foot of the bed to the head, as the deck, cavity, intermediate and head sections.

The details of sofa-beds in present common use differ in many details of construction and particularly with respect to the construction of a linkage system for controlling folding and unfolding of the aforesaid four sections. One commercially available sofa-bed frame is illustrated and described herein for sake of convenience and many of the parts of such construction which are not essential to an understanding of the invention are illustrated only schematically and not described in detail. Reference is made to U.S. Pat. Nos. 3,854,153 and 2,878,490 for details of such construction. It should be appreciated though that the present invention is useful as an improvement on all four-section sofa-bed construction known to applicant, irrespective of the linkage system used to support and guide those four sections during folding and unfolding.

A common objection to all commercial sofa-sleepers or sofa-beds is that they represent a compromise to a conventional sofa as a seating surface and to a conventional bed as a sleeping surface. In other words, sofa beds are generally conceded to not provide as comfortable a seating surface as a conventional couch or sofa, and to not provide as comfortable a sleeping surface as a conventional bed. Accordingly, it has been an objective of this invention to provide an improved sofa-bed which more closely simulates the seating comfort of a conventional couch and the sleeping comfort of a conventional bed.

The primary objection to sofa sleepers as a sleeping surface is that they tend to sag in the middle and to provide too little support for the shoulders and lower back of a person sleeping on them. As a seating surface they are usually criticized as providing too hard a seat or one which does not allow a person to slip down comfortably and easily at the back into the seating area. It has therefore been an objective of this invention to provide a sofa-sleeper which provides a firmer and yet still resilient sleeping surface over that which has heretofore been provided by sofa-beds. It has also been an objective to provide a sofa-bed construction in which the seat of the sofa-bed when folded is softer and has a more resilient comfortable feel than that provided by currently available sofa-beds.

To achieve these objectives, the sofa-bed of this application comprises the customary four foldable sections; the deck, cavity, intermediate, and head sections, all of which are positioned in a common horizontal plane when the bed is unfolded and all of which are folded at a 90° angle relative to adjacent sections in the seating attitude. In contrast to the usual sofa-sleeper though the intermediate and deck fabric sections of the sofa-sleeper of this invention are independently mounted and independently tensionable. Consequently, these two sections are mounted so as to be relatively loose and resilient in the seating position and relatively rigid and tightly tensioned in the sleeping position. In both positions of the bed though the deck and intermediate sections are spring supported so that they retain some resiliency.

To achieve this independent and resilient mounting of the deck and intermediate fabric sections, the cavity section of the bed has a rigid transverse anchor which extends across the cavity section and is fixed at either end to the side frame of the cavity section. The fabric of the deck section is attached at its rear or head end by first connectors to this cavity anchor and at its front or foot end to the front transverse rail by second connectors. One or both of the sets of connectors is resilient (i.e., preferably helical springs). The points at which the first connectors are attached to the deck fabric and to the cavity anchor are spaced relative to the joint or pivot axis where the deck and cavity section frames pivot. Hence, in seat position, the first connectors assume approximately the position of the hypotenuse of a right triangle, whereas in bed position they assume the position of the two sides of the triangle developed in a straight line and the sets of links are tensioned, thereby tensioning the fabric. Hence, in bed position, the fabric is taut, while in seat position it is loose.

The rear portion of the intermediate section also has a fixed transverse rigid anchor fixed at its opposite ends to the side rails of the intermediate section. The intermediate section fabric is attached at its front end to the cavity section anchor and at its rear end to the intermediate section anchor. Again, resilient links are used at one or the other, or both, of the ends of the intermediate section fabric to connect the fabric to the anchors. The location of the fabric supporting anchors relative to the intermediate section pivots is such that the intermediate section fabric also is tensioned when the sections are unfolded (i.e., in bed position) and relatively loose when folded into seat position.

The head section of the sofa-bed may consist of one or more rigid flat bars, or may be made of wire or textile fabric as in conventional sofa-beds. If fabric is used in the rear section, the front edge thereof is attached by resilient links to the intermediate section rear anchor (i.e., the rigid anchor at the rear or head end of the intermediate section).

One of the features of the invention is the fact that the fabric of the deck section is mounted independent of the fabric of the intermediate sections of the bed. As a result of this independent mounting, the sofa-bed constructed in accordance with the present invention is more comfortable than conventional sofa-beds both in seating position and bed position. In the seating position, there is extraordinary depth of flexure for a folding bed, being comparable with the flexure of the springs of non-folding sofas. In the bed position, this independent mounting of the intermediate fabric section permits the intermediate section to be separately and more tightly tensioned than has heretofore been possible. The result is that the intermediate fabric section, which bears most of the weight of a person during sleeping, provides a more comfortable sleeping surface than has heretofore been the case.

Another feature of the invention is the fact that it is not necessary to alter the side frame portion or linkages of conventional sofa-beds which provide for extension and retraction of the legs, compression of the mattress in seating position and the like. Merely by installing the transverse anchor members at the cavity section and at the rear or head end of the intermediate section and by suitable fabrication of the fabrics for the fabric section, any of the well known four section sofa-beds may be converted to the present invention. This feature permits the manufacturer to incorporate the present invention into a standard sofa-bed frame with very little modification.

A further feature of this invention relates to the textile fabric deck construction which results in reducing the bulge of the mattress when in seat position and eliminates the gaps which otherwise frequently occur between the bottom of the sofa cushions and the top of the front of the sofa frame. In one modification of this invention, there is a fabric flap sewn to the seat fabric adjacent the transverse rear edge thereof, as in a conventional construction. The flap passes under a transverse deck reinforcing rod which is located below the deck frame when the frame is located in a bed position. The rear edges of the flap and of the deck fabric are drawn tightly together and clipped to the aforementioned fixed transverse cavity anchor. In seat position, a forward pull is exerted by this construction on the deck fabric to reduce the aforesaid bulge of the folded-over mattress.

Accordingly, the present invention improves both the comfort and appearance of the sofa in seat position.

Other objects and advantages of the present invention will become apparent upon reading the following specification and referring to the accompanying drawings in which similar characters of reference represent corresponding parts in each of the several views.

Figure 1:
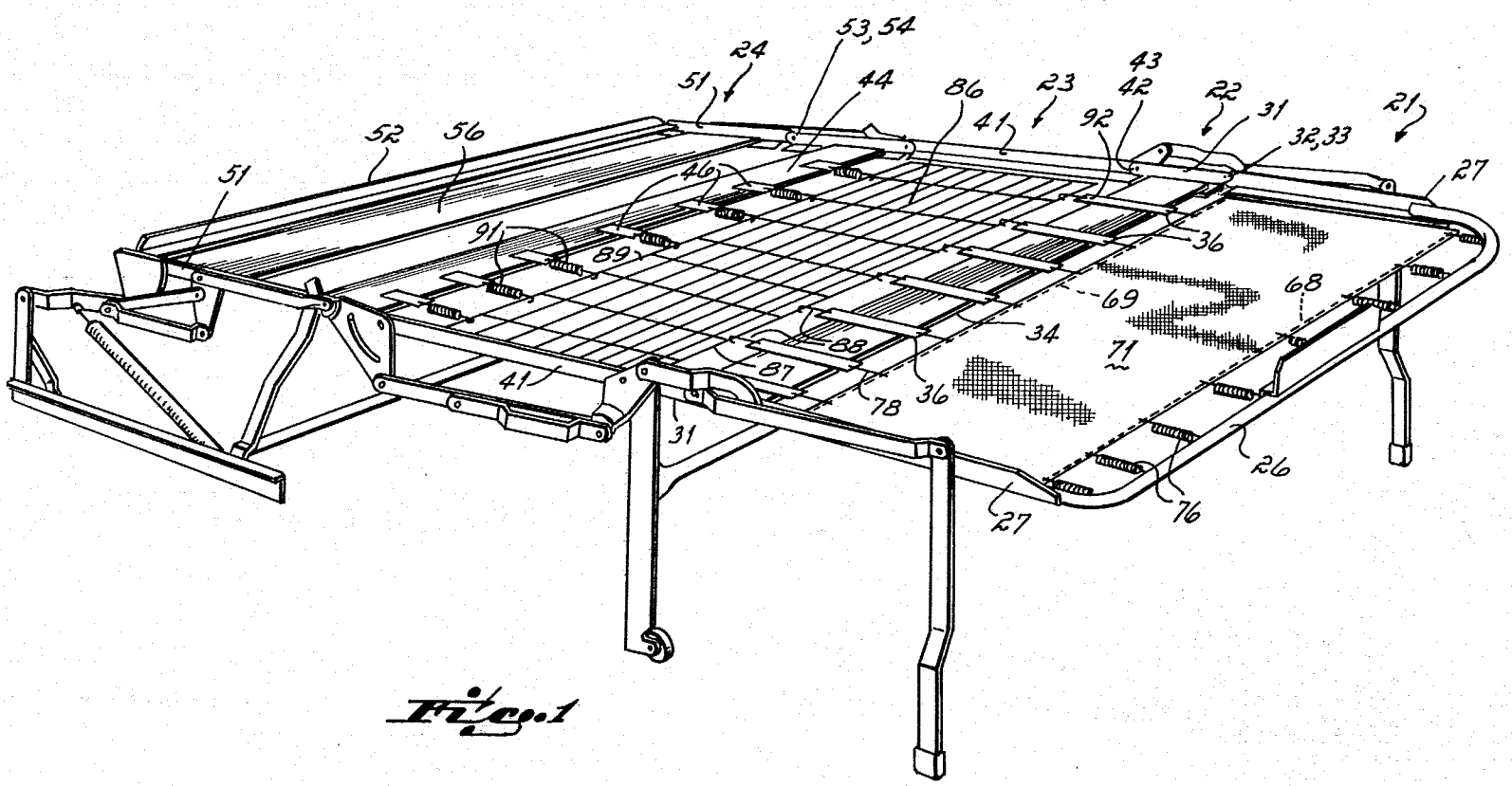
FIG. 1 is a perspective view of a sofa-bed in accordance with the present invention with certain parts removed for clarity of illustration.
Figure 2:
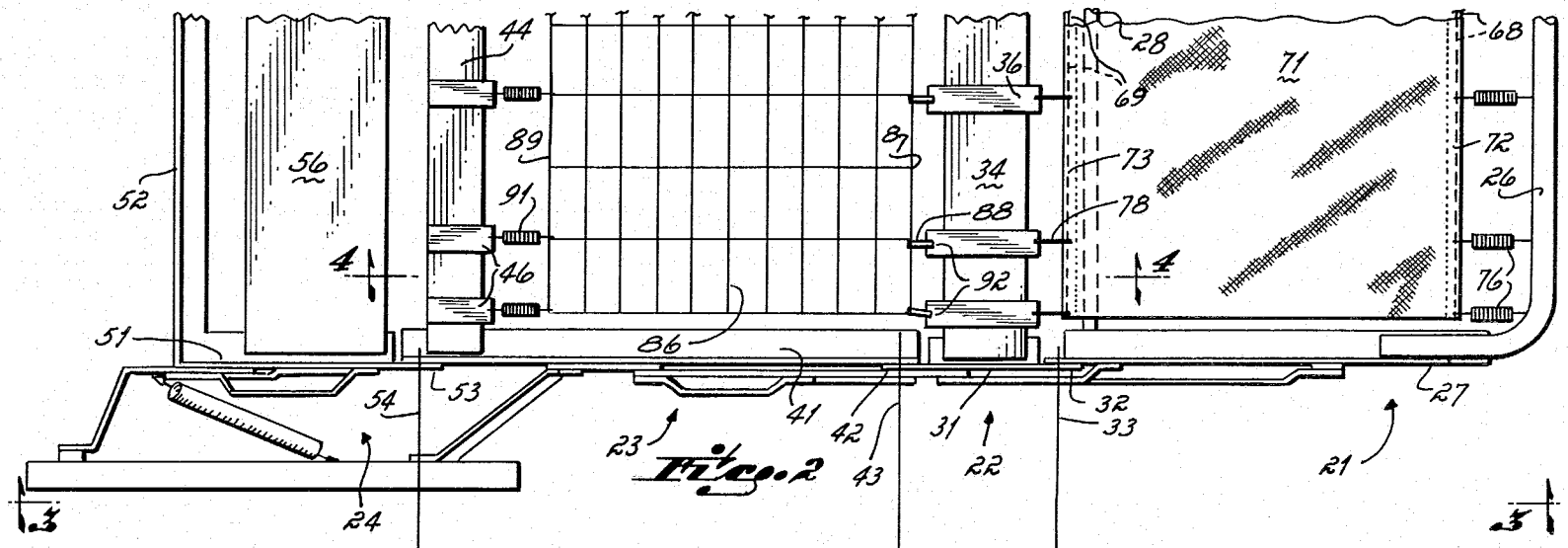
FIG. 2 is a fragmentary top plan view of the structure of FIG. 1 also with parts removed for clarity of illustration.

As has been stated, the present invention may be incorporated in a variety of different multi-section sofa-beds. For convenience, one particular construction is illustrated, but many of the parts thereof, such as the support legs, the linkages which extend and retract said legs, the additional linkages which swing the rear frame section under the rear sofa cushions and the means which compresses the mattress when the sofa-bed is in seating position are illustrated but not described. It will be understood that various manufacturers have different linkages to accomplish these results.

Essentially, the four sections of the sofa-bed illustrated herein, proceeding from the foot of the bed toward the head, comprise the deck section 21, the cavity section 22, the intermediate section 23 and the head section 24. In seating position, the four sections are folded so that each section is substantially at 90° with respect to the adjacent sections, whereas in bed position the sections are essentially horizontal.

Deck Frame

The frame of the deck section 21 comprises a front rail 26 which extends transversely across the front of the device and side rails 27 on either side extending rearwardly from the front rail 26. Preferably the side rails are made of angle bar stock. Below the level of the side rails 27 is a transverse deck reinforcing rod 28, which is joined to the side rails 27 by downward offsets 29.

Cavity Frame

The frame for cavity section 22 comprises side rails 31 which are located adjacent the rails 27 and meet at a first joint 32. The vertical flanges of rails 27 and 31 are pivoted by means of a first pivot 33 which may be a rivet.

A feature of the cavity frame is the use of a flat transverse member 34 which is relatively rigid and is joined at opposite ends to the side rails 31. For purposes of attachment of clips, hereinafter describd in detail, the transverse member 34 may be provided with longitudinally extending straps 36, which extend beyond the front and rear edges of the transverse member 34.

Intermediate Frame

The frame for the intermediate section 23 also has side rails 41 which are disposed immediately adjacent the rails 31 and meet at a second transverse joint 42 and are pivoted around a second pivot 43. At the rearward end of the rails 41 is a transverse member 44, which may be similar in construction to the member 34. Straps 46 attached to member 44 project forwardly of the member 44 for attachment to springs as hereinafter described.

Rear Frame

The frame for the rear section 24 comprises side rails 51 and transverse back rail 52. The side rails 51 meet the rails in a transverse third joint 53. Rails 51, 41 are pivoted together at a third pivot 54. In a preferred form herein illustrated, a transverse member 56 is secured at either end to rails 51. The structure of member 56 is subject to considerable modification and, in fact, as hereinafter described, may be replaced by steel tubing or by a panel of textile or wire fabric similar to that used in conventional sofa-beds.

Sofa Frame

Figures 9, 10:
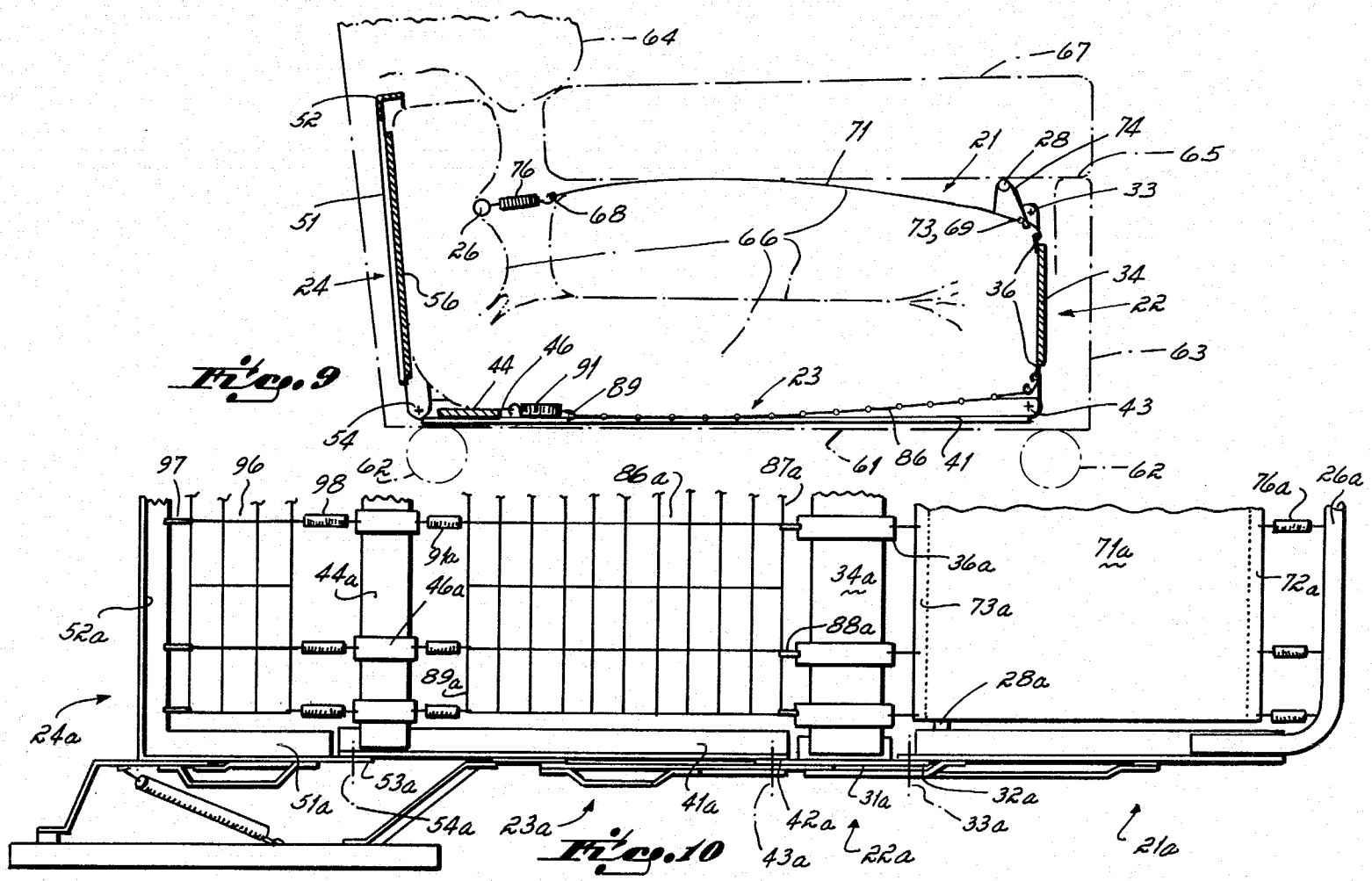
FIG. 9 is an enlarged sectional view showing the sofa-bed in seat position with parts removed for clarity of illustration.
FIG. 10 is a fragmentary plan view of a modification.

A sofa-bed is illustrated schematically in FIG. 9. The design of the frame of such device is subject to wide variaion. Generally, such frames are constructed of wood and are suitably upholstered. As illustrated, there is a bottom 61 supported above the floor by legs 62. The front 63 extends above the folded frame, or in other words its top edge 65 is higher than the cavity or boxing section 22. Generally, there is an upholstered back cushion 64. Conventionally, there are one or more removable seat cushions 67 which fit on top of the folded deck section 21 and lie between the back cushion 64 and rest on the front 63.

Figure 3:
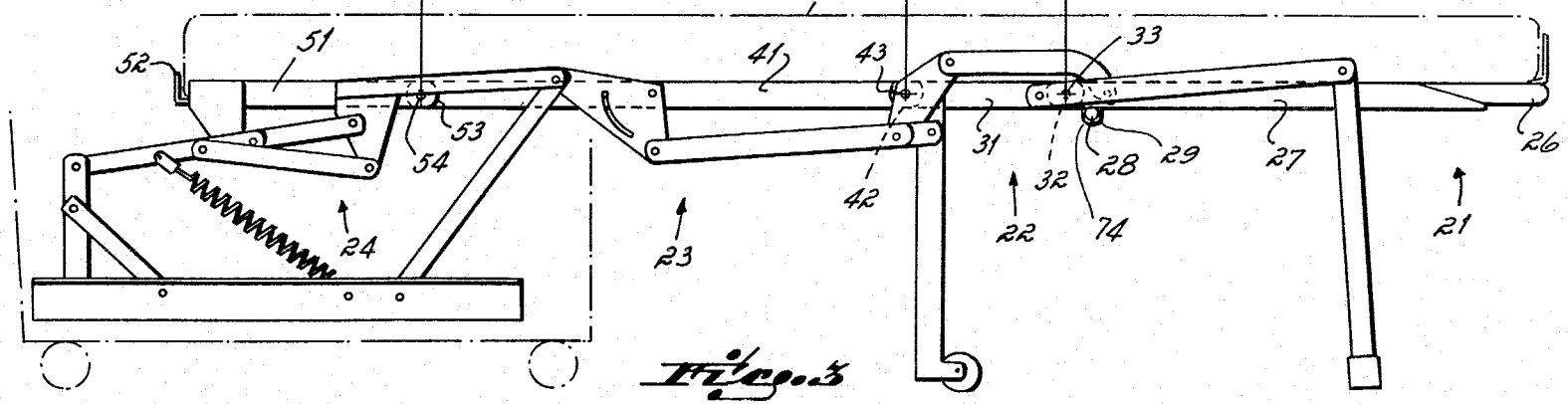
FIG. 3 is a schematic sectional view, taken substantially along the line 3—3 of FIG. 2.
Figures 4, 5, 6, 7, 8:
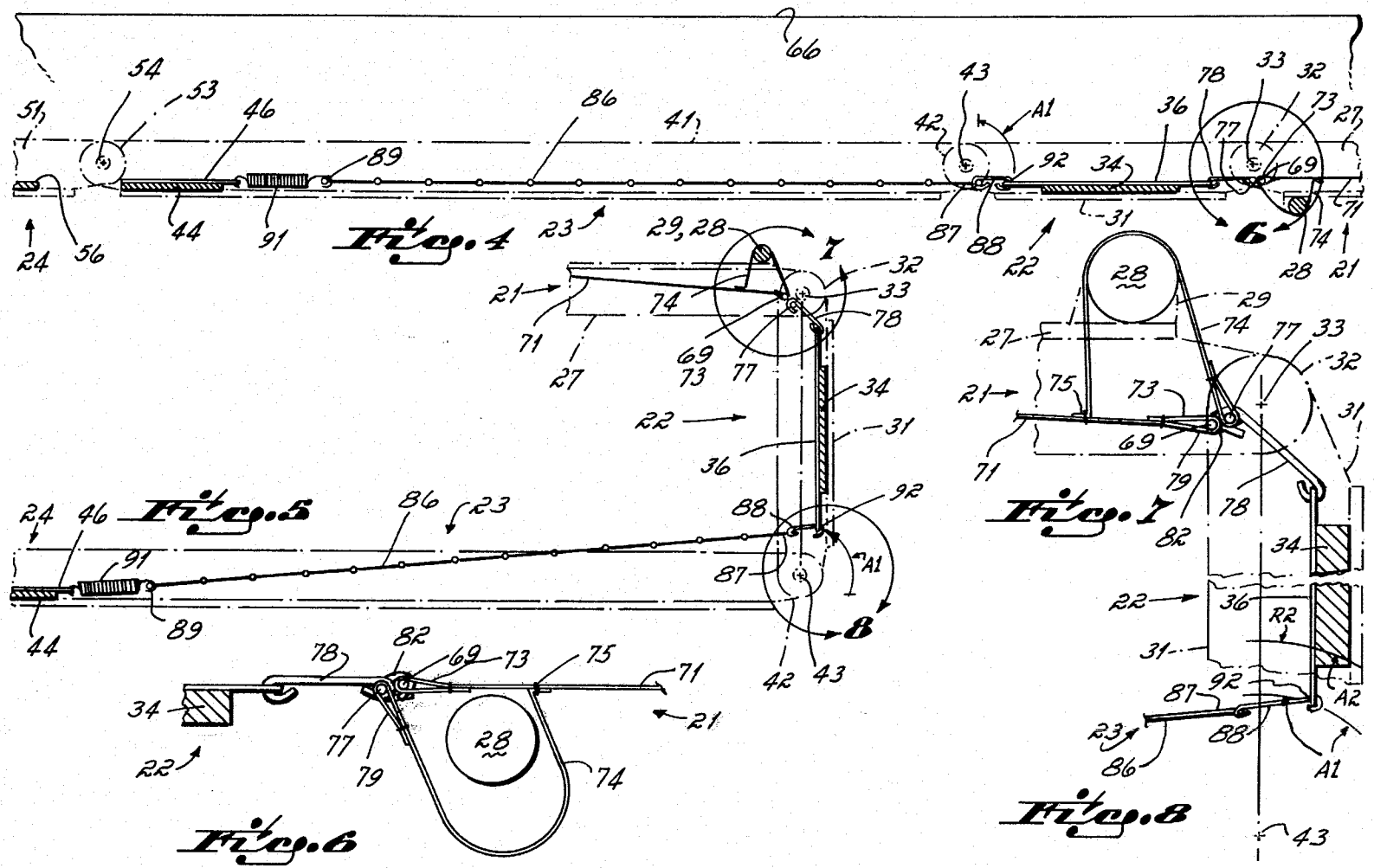
FIG. 4 is a fragmentary schematic sectional view taken substantially along line 4—4 of FIG. 2.
FIG. 5 is a schematic view similar to FIG. 4 except the sofa-bed has been folded to illustrate the parts in a seat position.
FIG. 6 is an enlarged view of the encircled portion 6 of FIG. 4.
FIG. 7 is an enlarged view of the encircled portion 7 of FIG. 5.
FIG. 8 is an enlarged view of the encircled portion 8 of FIG. 5.

A mattress 66 is supported by the bed as shown in FIGS. 3 and 4. When the bed is folded into seating position, the mattress is folded as shown in FIG. 9. In this connection, it will be noted that the rear section 24 (see FIG. 9) assumes a nearly vertical position tucked under the back cushion 64 and the intermediate section 23 is suspended between the cavity 22 and rear 24 sections. The cavity section 22 is vertical immediately behind the front 63 and the deck 21 is approximately horizontal and supports the sofa cushions 67. Cushions 67 are horizontal and rest on edge 65 with no gap therebelow by reason of a mattress pull down feature hereinafter described.

Deck Construction

As illustrated, textile fabric 71 comprises the principal portion of the deck section 21, although it will be understood that other materials may be employed. The fabric 71 is formed with a front hem 72 and rear hem 73 which may be reinforced by transverse wires 68, 69, welts or other reinforcements. In the particular construction illustrated herein, but not used in some other sofa constructions, there is a flap 74 sewn at its forward edge to the underside of fabric 71 at seam 75 and looped beneath the deck reinforcing rod 28 while the main portion of the fabric 71 fits over the rod 28. Flap 74 has a rear hem 79 in which is a wire 77 or welt. Wires 69 and 77 are brought close together by a fastener 82 such as a "hog ring".

The front hem 72 by means of its wire 68 is connected to the front rail 26 by transversely spaced apart helical springs 76, the hooked ends of the springs 76 fitting through holes in the hem 72 and around wire 68 and holes (not shown) in the rail 26. Conventional wire links 78, used in sofa-bed constructions, clip the wire 69 of hem 73 and wire 77 to straps 36. As particularly appears in FIGS. 7, 9 and 5, when in seat position, the effect of flap 74 is to contain the front edge of the folded mattress 66 which reduces the upward bulge or crown at the front edge in the seat position. Thus, cushion 67 rests horizontally on edge 65 and the gap which frequently occurs between the front rail 63 and the cushion 67 in this region is reduced or eliminated.

The foregoing construction is subject to considerable modification. The construction of the members 34 may be considerably varied. In one variation, the rearward edge of whatever clip is used to secure fabric 71 to the member 34 fits through an appropriate opening in the member 34 rather than using a strap 36. In another modification, the straps take the form of heavy wires supported from a transverse steel tube. Other variations of construction will readily occur to one skilled in the art.

The importance of the construction of the present invention may be observed by comparing FIG. 4 with FIG. 5. In the bed position shown in FIG. 4, the distance between the front rail 26 and the point at which the clip 78 is attached to the strap 36 is sufficiently longer than in the seated position so that the springs 76 are stressed, causing the deck fabric 71 to be taut and the deck portion 21 firm, a desirable condition in bed position. In seat position (schematic FIG. 5) link 78 and the attached fabric 71 are approximately in the position of a hypotenuse and the fabric 71 is relaxed rather than taut, a desirable condition in sofa-bed construction. Thus, in FIG. 5 the arrangement is similar to the hypotenuse of a right triangle while in FIG. 4 the position is that of the two sides of such triangle developed in a straight line—a greater length than the hypotenuse. This feature, plus the similar stressing of the intermediate section 23, are important advantages of the present invention.

Intermediate Section Construction

As illustrated herein, intermediate section 23 consists primarily of wire fabric 86 of the conventional type used in sofa-bed construction. It will be understood that textile fabric or other materials may be substituted. In bed position, the intermediate section 23 has the principal burden of the weight of adult occupants and it is desirable that the wire fabric 86 be stressed to provide a firm bed. The front edge 87 of wire fabric 86 is attached to the rearward ends of the straps 36 by clips 88. It will be understood that, by variation of construction of the transverse member 34, the straps 36 may be eliminated and the forward ends of the clips 88 attached to appropriate apertures integral with the member 34. The rear edge 89 of the fabric 86 is attached by coil springs 91 to straps 46 fixed to transverse member 44. Again, it will be understood that the springs 91 may be attached directly to suitably apertured portions of the transverse member 44.

In comparing the condition of the wire fabric 86 shown in FIG. 4 with that shown in FIG. 5, it will be seen that the fabric 86 is tensioned in FIG. 4 to provide a firm bed. In FIG. 5, however, fabric 86 and clip 88 assume approximately the position of the hypotenuse of a right triangle and hence the overall distance between the point of attachment to the strap 46 and the point of attachment to strap 36 is less than in FIG. 4. This results in flexibility of the wire fabric 86, improving the comfort of the construction in seating position.

FIGS. 5 and 8 illustrate the geometry of the tensioning of springs 91 between bed and seat positions. The intermediate frame side member 41 is pivoted to the cavity frame side member 31 at pivot 43. In the seat position, spring 91, wire fabric 86, and link 88 represent approximately the hypotenuse of a right triangle of which portions of the side frame members 41 and 31 represent the right angle sides. A1 represents an arc about pivot 43 made by the pivot of attachment 92 of wire fabric 86 with rigid transverse frame member 34. This is the arc A1 travels by the attachment pivot 92 moving from seating position to bed position. In practice there is approximately ½" extension of spring 91 if it is attached to strap 46 in the manner illustrated in FIGS. 5 and 8 in the course of moving from seat to bed position. R2 shows the further displacement of arc A2 if spring 91 is attached to strap 46 and thus transverse frame element 34 at a greater distance from pivot 43. Theoretically, and very approximately in seat position spring 91, fabric 86, and link 88 represent the hypotenuse of a right triangle having legs 41, 31. In bed position, the same spring 91, fabric 86, and link 88 are in a common horizontal line which comprises the sum of the two sides of the triangle such that their combined length is greater than the hypotenuse. This difference in length is accommodated by the springs 91 which are tensioned to draw taut the wire fabric 96 in the course of moving from folded sofa to unfolded bed position.

This same triangular geometry likewise applies to the stretching of deck fabric 71 between seat and bed positions. In the course of the lengthening of the hypotenuse of the triangle formed by the springs 76, fabric 71, and links 78 in moving from seated to bed position, the springs 76 are tensioned and the fabric 71 is drawn taut.

Modifications

As has been stated, the sofa-bed construction illustrated in FIGS. 1–9, is an improvement upon the commercially available sofa-bed construction. The principles of the present invention may be applied to all four-piece sofa-beds known to applicant by modifications which will readily occur to one skilled in the art and which are not here illustrated or described. However, there are other modifications of the invention which have occurred to applicant, as set forth below.

In some constructions, hems 73, 79 are clipped to a transverse wire and such wire clipped to straps 36 or directly to member 34.

Another modification is the reversal of the positions of the springs 76 and the clips 79. Similarly, there may be a reversal of position of the springs 91 and the clips 88. Indeed, the clips may be replaced by springs so that two (preferably small) springs support the fabric.

The rear section 24 is herein illustrated as a solid panel 56. Several individual transverse members may be substituted for the single panel 56. Further, instead of the rear section 24 being built up of one or more rigid transverse members, textile or wire fabric may be substituted, the rearward edges of the fabric being joined to the rear transverse rail 52 and the forward edges thereof being attached by means of coil springs to the rearward edge of the member 44.

FIG. 10 illustrates the aforesaid modification in which the solid panel 56 of rear section 24 is replaced with wire fabric 96. The rear edge of fabric 96 is clipped by clips 97 to transverse frame member **52*a*. Coil springs 98 connect the front edge of fabric 96 to straps 46*a* fixed to member 44*a*. In this modification straps 46*a* extend both forwardly and rearwardly of member 44*a*. Many of the elements of this modification resemble those of the preceding modifications, and the same reference numerals followed by subscript a represent corresponding parts. The tensioning of fabric 96 in bed position and relaxing thereof in seat position is accomplished in a similar way as the fabrics 71 and 86** in the preceding modification.

While I have described only a single preferred embodiment of my invention, persons skilled in the art to which it pertains will appreciate numerous changes and modifications which may be made without departing from the scope of the invention. Therefore, I do not intend to be limited except by the scope of the following appended claims.

Having described my invention, I claim:

1. A foldable sofa-bed of the type having serially connected deck, cavity, and intermediate sections movable between a folded seat position and a flat unfolded bed position, said deck and intermediate sections being pivotally joined to opposite ends of said cavity section at transverse pivot axes, said deck section being located at a foot end of said sofa-bed and said intermediate section being located at the head end of said sofa-bed and said cavity section having a rigid transverse anchor extending between opposite sides thereof, said deck section having a transverse rail at the foot end thereof and a deck fabric extending between and secured to said end rail and said cavity section transverse anchor, a second rigid transverse anchor located at the head end of said intermediate section and an intermediate section fabric extending between and secured at one end to said second transverse anchor and at the opposite end to said cavity section anchor, the point of attachment of said deck fabric to said cavity section anchor being offset relative to the pivot axis between said deck section and said cavity section and the point of attachment of said intermediate section fabric to said cavity section anchor being offset relative to the pivot axis between said intermediate section and said cavity section such that in seat position of said sofa-bed said deck fabric and said intermediate section fabric each tends to generally assume the position of a hypotenuse of a right triangle and in bed position assume the position of two sides of the right triangle containing said hypotenuse developed in a straight line such that said deck fabric and said intermediate section fabric is each independently drawn taut in bed position and relaxed in seat position.

2. The foldable sofa-bed of claim 1 wherein said deck fabric is connected to said rail by a plurality of resilient springs and said intermediate section fabric is connected to said second transverse anchor by a plurality of resilient springs so that the rear seating surface of said sofa-sleeper is resiliently supported when in the folded seat position.

3. The sofa-bed according to claim 1 in which said deck fabric is of textile material.

4. The sofa-bed according to claim 1 in which said deck fabric has a transverse boundary wire at the end which is located adjacent said cavity section, and a plurality of connector means extending between said boundary wire and said cavity section transverse anchor.

5. The sofa-bed according to claim 1 which further comprises a plurality of longitudinally extending members mounted on said cavity section rigid transverse anchor and first connector means extending between each of said longitudinally extending members and said deck fabric.

6. The sofa-bed of claim 5 which further includes second connector means extending between each of said longitudinally extending members and said intermediate section fabric.

7. The sofa-bed according to claim 6 in which said first and second connector means are wire clips.

8. The sofa-bed according to claim 1 in which said deck section further comprises a transverse reinforcing rod located adjacent said cavity section and below the level of said deck fabric when in bed position, a flap attached to said deck fabric member adjacent to the end which is secured to said cavity section transverse anchor, said flap passing under said rod, a mattress on said sofa-bed which is flat in bed position and folded over in seat position, and connector means securing the edge of said flap remote from the point of attachment of said flap to said deck fabric to said cavity section transverse anchor whereby in bed position said flap is loose below said rod and in seat position said flap is drawn downward by said cavity section anchor means to flatten and compress said mattress.

9. A sofa-bed according to claim 8 which further comprises a first boundary wire in the end of said deck fabric which is secured to said cavity section anchor and a second boundary wire in said edge of said flap, said connector means securing said boundary wires closely together and to said cavity section transverse anchor.

10. A sofa-bed according to claim 9 in which said connector means includes a plurality of hog-ring-type elements.

11. A foldable sofa-bed of the type having serially connected deck, cavity, and intermediate sections movable between a folded seat position and a flat unfolded bed position, said deck and intermediate sections being pivotally joined to opposite ends of said cavity section at transverse pivot axes, said deck section being located at a foot end of said sofa-bed and said intermediate section being located at the head end of said sofa-bed and said cavity section having a rigid transverse anchor extending between opposite sides thereof, a second rigid transverse anchor fixed to said intermediate section adjacent the end of said intermediate section remote from said cavity section, an intermediate section fabric member having a first end adjacent said cavity section and a second end remote from said first end, first connector means securing said first fabric end to said cavity section rigid transverse anchor, second connector means securing said second fabric end to said second rigid transverse anchor, and the point of attachment of said first connector means to said cavity section rigid transverse anchor being offset relative to the pivot axis between said cavity section and said intermediate section, whereby in seat position of said sofa-bed said first and second connector means and said intermediate section fabric member tend to generally assume the position of the hypotenuse of a right triangle and in bed position assume the position of two sides of the same right triangle developed in a straight line, said intermediate section fabric member being thereby drawn taut in bed position and relaxed in seat position independently of the tautness of any fabric members attached to any other bed sections.

12. The foldable sofa-bed of claim 11 in which at least one of said first and second connector means is resilient.

13. The foldable sofa-bed of claim 11 in which said second connector means comprises a plurality of helical springs.

14. A foldable sofa-bed of the type having serially connected deck, cavity, and intermediate sections movable between a folded seat position and a flat unfolded bed position, said deck and intermediate sections being pivotally joined to opposite ends of said cavity section at transverse pivot axes, said deck section being located at a foot end of said sofa-bed and said intermediate section being located at the head end of said sofa-bed and said cavity section having a rigid transverse anchor extending between opposite sides thereof, a second rigid transverse anchor extending between opposite sides of said intermediate section at the head end of said intermediate section, and an intermediate section fabric extending between and secured at one end to said second transverse anchor and at the opposite end to said cavity section anchor, the point of attachment of said intermediate section fabric to said cavity section anchor being offset relative to the pivot axis between said intermediate section and said cavity section such that in seat position of said sofa-bed said intermediate section fabric tends to generally assume the position of a hypotenuse of a right triangle and in bed position assume the position of two sides of the right triangle containing said hypotenuse developed in a straight line such that said intermediate section fabric is drawn taut in bed position and relaxed in seat position independently of the tautness of any fabric attached to any other section of said sofa-bed.

15. The foldable sofa-bed of claim 14 wherein said intermediate section fabric is connected to said second rigid transverse anchor by a plurality of resilient springs so that the rear of said intermediate section fabric is resiliently supported when in the folded seat position.

16. A foldable sofa-bed of the type having serially connected back, cavity, and intermediate sections movable between a folded seat position and a flat unfolded bed position, said deck and intermediate sections being pivotally joined to opposite ends of said cavity section at transverse pivot axes, said deck section being located at a foot end of said sofa-bed and said intermediate section being located at the head end of said sofa-bed and said cavity section having a rigid transverse anchor extending between opposite sides thereof, said deck section having a transverse rail at the foot end thereof and a deck fabric extending between and secured to said end rail and said cavity section transverse anchor, a second rigid transverse anchor located at the head end of said intermediate section and an intermediate section fabric extending between and secured at one end to said second transverse anchor and at the opposite end to said cavity section anchor, the point of attachment of said deck fabric to said cavity section anchor and the point of attachment of said intermediate section fabric to said cavity section anchor being such that in seat position of said sofa-bed said deck fabric and said intermediate section fabric are relatively loose and in bed position are each independently drawn taut.

* * * * *

UNITED STATES PATENT AND TRADEMARK OFFICE

CERTIFICATE OF CORRECTION

PATENT NO. : 4,381,570

DATED : May 3, 1983

INVENTOR(S) : Charles Schneider

It is certified that error appears in the above-identified patent and that said Letters Patent is hereby corrected as shown below:

Claim 16, line 2, "back" should be -- deck --

Signed and Sealed this

*Twenty-seventh* Day of *December 1983*

[SEAL]

*Attest:*

GERALD J. MOSSINGHOFF

*Attesting Officer*

*Commissioner of Patents and Trademarks*